United States Patent [19]

Mueller

[11] 4,236,769

[45] Dec. 2, 1980

[54] ROTATING DISPLAY STAND

[76] Inventor: Martin L. Mueller, 4929 E. Lake Shore Dr., Wonder Lake, Ill. 60097

[21] Appl. No.: 18,783

[22] Filed: Mar. 8, 1979

[51] Int. Cl.[3] ..... A47F 5/02

[52] U.S. Cl. ..... 312/135; 211/144; 312/202; 312/252

[58] Field of Search ..... 312/125, 135, 197, 202, 312/234.2, 236, 252; 211/1.5, 144

[56] References Cited

U.S. PATENT DOCUMENTS

| | | | |
|---|---|---|---|
| 1,470,217 | 10/1923 | Claus | 211/144 |
| 2,194,238 | 3/1940 | Weaver | 312/135 |
| 3,245,545 | 4/1966 | Hortie | 312/202 |
| 3,942,647 | 3/1976 | Crosslen | 211/144 |
| 4,062,983 | 12/1977 | Roderick | 312/236 |

*Primary Examiner*—Casmir A. Nunberg
*Attorney, Agent, or Firm*—Dressler, Goldsmith, Shore, Sutker & Milnamow, Ltd.

[57] ABSTRACT

A display stand is provided with a plurality of ring-like shelves arranged in a vertical array above a base with the first, third, fifth, etc., shelves above the base being in a first group which are rotatable in a first direction and with the second, fourth, sixth, etc., shelves above the base being in a second group which are rotatable in a second, opposite direction. A plurality of rotatable drive rods are spaced equidistantly around a circle in the base and project upwardly therefrom within the interior of the ring-like shelves. Each drive rod carries fixed rollers which rotate with the drive rod and which each have an annular groove therein for supporting and frictionally engaging an inner portion of one of the ring-like shelves. One half of the drive rods are thus engaged with the first group of shelves and are driven by a motor to rotate in the first direction. The other half of the drive rods are thus engaged with the first group of shelves and are driven to rotate in the second, opposite direction. When a predetermined amount of resistance torque is applied to one of the shelves upon removal of an article from that shelf, the frictional driving torque is overcome and that shelf remains stationary while the rollers engaged with that shelf slip relative to the shelf and continue to rotate.

27 Claims, 11 Drawing Figures

239
240
230
50
242
243
241
52
125
206
123
204
46
45
41
44
244
250
122
21
121
250
208
202
21
38
52
80
82
48
40
84
94
91
37
33
39
102
30
41
31
31
32
4
4
5
5

230
236
232
242
72
50
70
234
125
106
210
121
208
202
44
80
82
48
84
94
35
104
106
34
34
33
102
36
32

50
62
60
52
56
58
48

ROTATING DISPLAY STAND

TECHNICAL FIELD

This invention relates to the apparatus for displaying and vending articles and more particularly to a stand having a plurality of rotating holders or shelves on which comestible articles can be displayed and from which the articles can be easily removed when desired.

BACKGROUND ART

Upstanding rotatable display racks or stands having a plurality of vertically spaced shelves for holding articles are in common use today. In some stands, all of the shelves rotate together about a common vertical axis and in others the shelves are adapted to be individually manually rotated by a prospective purchaser.

SUMMARY OF THE PREFERRED EMBODIMENT OF THE INVENTION

The preferred embodiment of the stand of the present invention has a base upon which a plurality of upstanding drive rods are mounted in a circle of equidistantly spaced locations and which are each adapted for rotation about their individual longidutinal axes. A motor is provided within the base and is connected by a gear drive assembly to each of the upstanding drive rods for rotating the drive rods, half of which, owing to the unique gear arrangement, rotate in a first direction as a first group, and other half of which rotate in a second, opposite direction as a second group. A plurality of drive rollers are fixedly mounted to each of the drive rods at vertically spaced locations along the rods above the base and are secured to the rods for rotation therewith. Each roller has a horizontally aligned annular groove with a generally rectangular cross section.

A plurality of ring-like article holding members, upon which articles are placed for display, are disposed in a generally spaced-apart vertical array for rotation about a common vertical axis perpendicular to the planes of the ring-like members. An annular inner portion of each ring-like member is received within, and frictionally engaged by, the annular groove in a number of the drive rollers at spaced locations around the inner circumference of the ring-like member whereby rotation of the drive rods rotates the rollers against the ring-like members to thereby rotate the members.

Preferably, the array of ring-like article holding members is comprised of a first and second group of holding members wherein a member from the first group is disposed between a pair of adjacent members from the second group. The first group of holding members is supported by and drivably engaged with the first group of upstanding drive rods and rollers while the second group of holding members is supported by and engaged with the second group of upstanding drive rods and rollers. Consequently, each ring-like holding member rotates in a direction opposite from that of the adjacent members above and below it.

The ring-like members are adapted to be driven by frictional engagement with the surfaces of the drive rollers defining the annular groove in each roller so that when a predetermined amount of resistance torque is applied to a ring-like holding member, the rotation of that holding member can be arrested while the drive rod and drive roller slip against the holding member and continue to rotate. This permits any holding member to be easily stopped from rotating when it is desired to remove an article therefrom. Also, since the drive rods continue rotating relative to the stopped holding member, the other holding members above or below the stopped holding member which are engaged with the same drive rods can continue to rotate.

Preferably, the display stand is fitted with a transparent enclosure which has an aperture for permitting access to the articles on display as they rotate past the aperture. A heating means is provided within the enclosure for heating the ambient air within the enclosure and for thus maintaining the articles, such as hot food, at a desired elevated temperature.

Thus, it is seen that the combined effect of the various elements associated in accordance with the present invention is greater than the sum of the several effects of those elements taken separately. The novel combination of elements in accordance with the present invention yields desirable, beneficial and synergistic results—results which are not only unusual and surprising, but also provide a substantial improvement over the prior art.

Numerous other advantages and features of the present invention will become readily apparent from the following detailed description of the invention and embodiments thereof, from the claims and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENT

Figure 1:
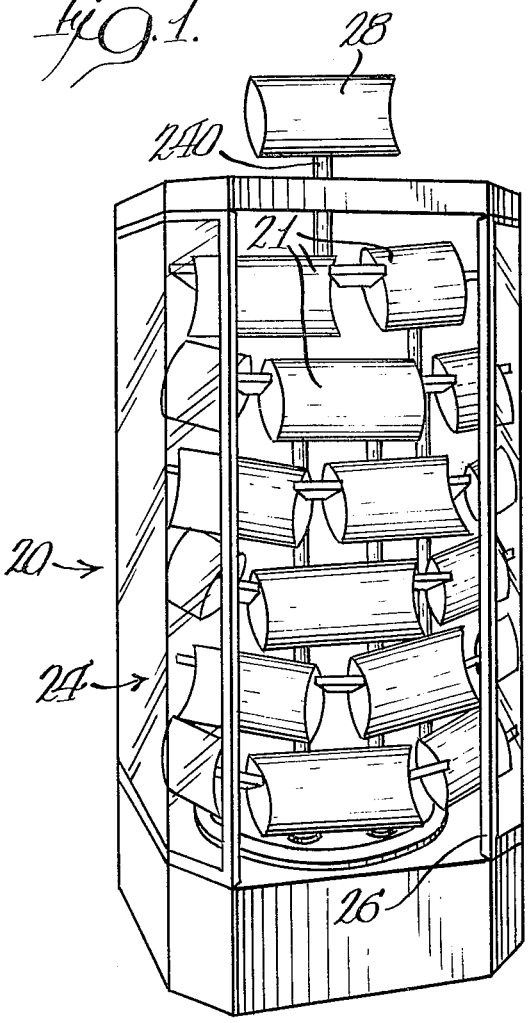
FIG. 1 is a perspective view of the display stand of the present invention with articles mounted thereon.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

The precise shapes and sizes of the components herein described are not essential to the invention unless otherwise indicated, since the invention is described with reference to an embodiment which is simple and straightforward.

For ease of description, the apparatus of this invention will be described in a normal operating position, and terms such as upper, lower, horizontal, etc., will be used with reference to this normal operating position. It will be understood, however, that the apparatus of this invention may be manufactured, stored, transported and sold in an orientation other than the normal operating position described.

The apparatus of this invention has certain conventional drive mechanisms and control mechanisms the details of which, though not fully illustrated and described, will be apparent to those having skill in the art and an understanding of the necessary functions of such mechanisms.

FIG. 1 illustrates one form of the display stand 10 according to the present invention. The stand is adapted to hold a plurality of articles, such as packages of food 21, in vertically spaced circular rows. Each row may have a different type of food package. Each package revolves in a circle on the display stand and can be easily removed therefrom when desired as will be explained in more detail hereinafter.

The stand 20 has a base, frame or base enclosure 30 (FIG. 2) by which the stand can be supported on a counter or floor. The stand 20 has an enclosure 24 extending around the base 30 and upwardly therefrom to protect the packages 21. The enclosure 24 is preferably transparent above the base 30 and extends around the periphery of the stand 20 except for an aperture 26 which allows access to the packages 21. The enclosure 24 is removable in its entirety for ease of restocking the display stand with packages 21.

For display and advertising purposes, a special or empty package 28 may be mounted above the top of the stand 20 for rotation therewith as will be explained in more detail hereinafter.

Figure 2:
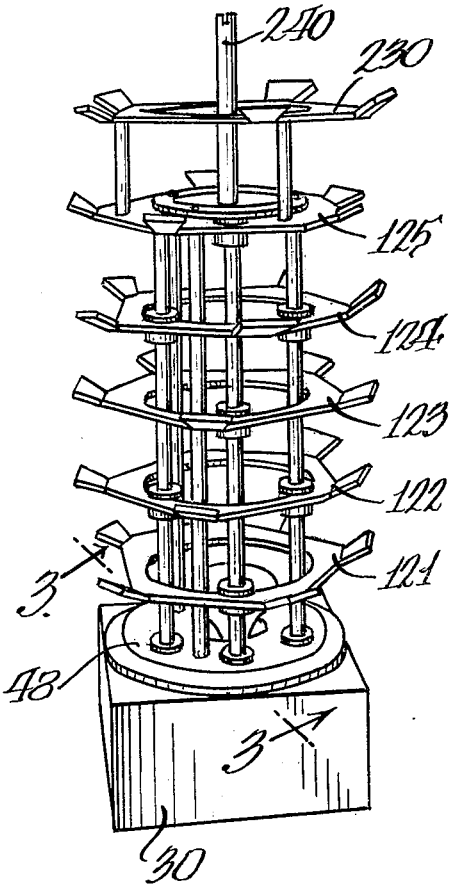
FIG. 2 is a perspective view similar to FIG. 1 but with the articles and transparent enclosure removed from the stand.
Figure 3:
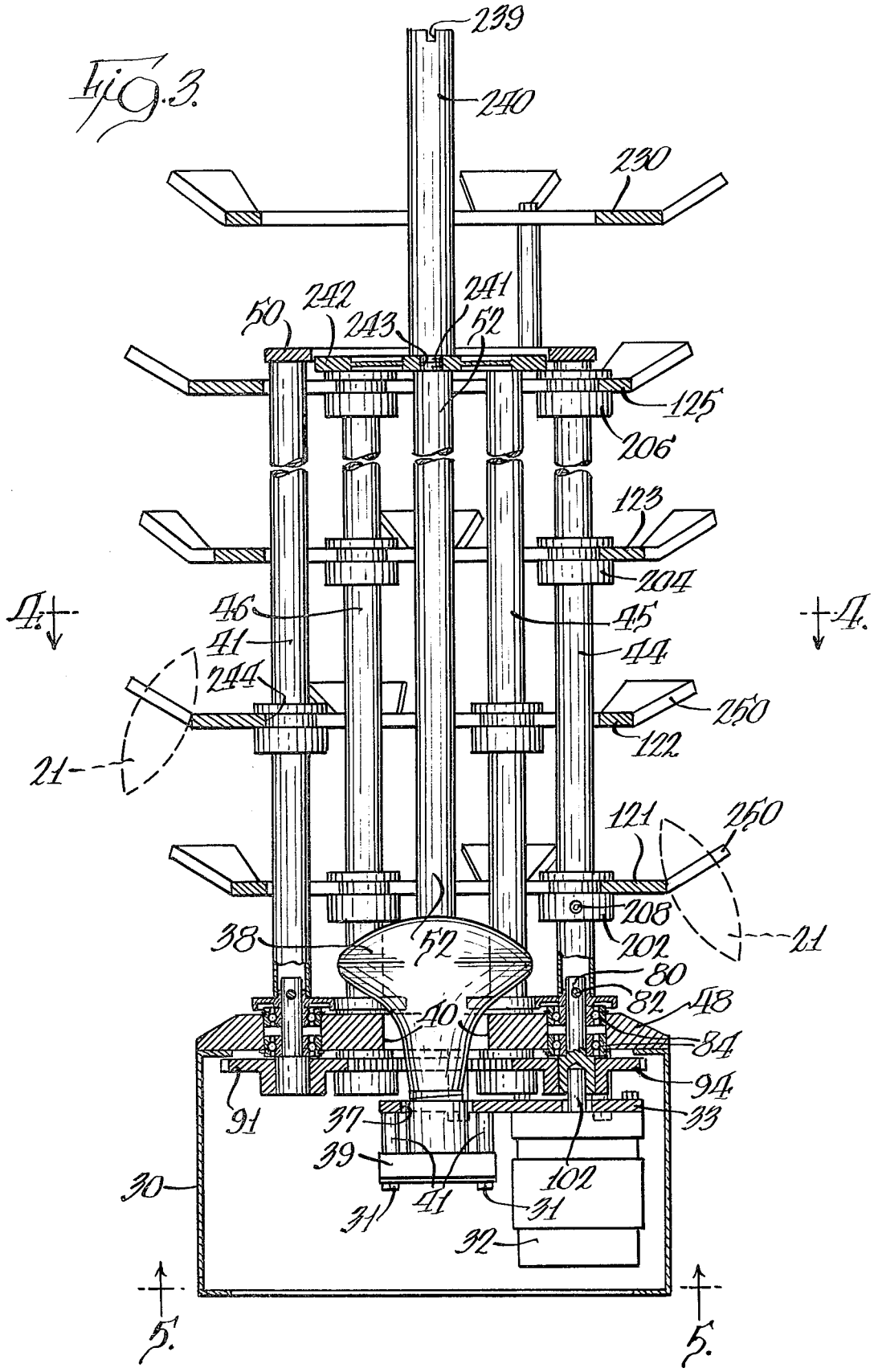
FIG. 3 is an enlarged, cross-sectional view of the stand of the present invention taken generally along the plane 3—3 in FIG. 2.
Figure 5:
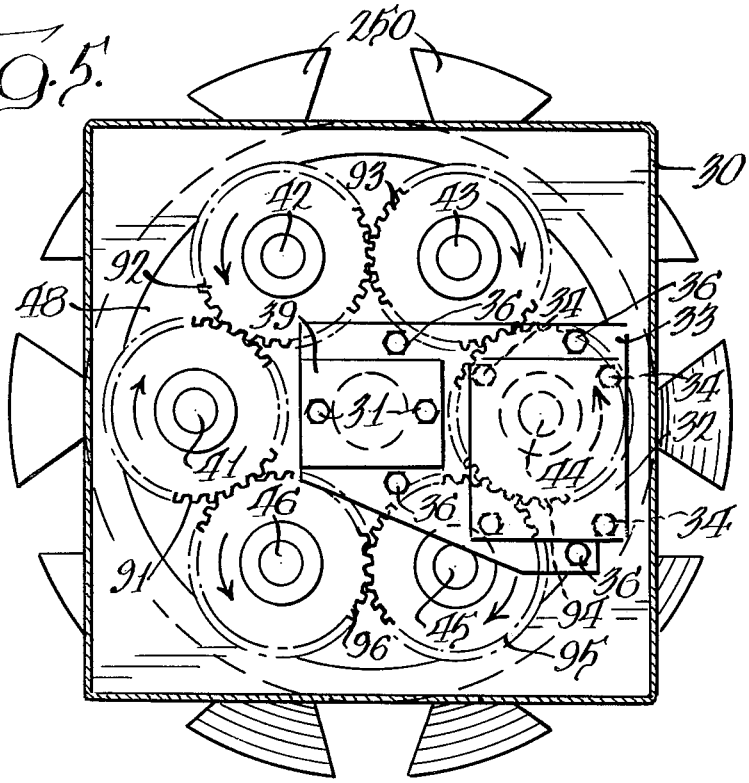
FIG. 5 is a cross-sectional view taken along the plane 5—5 in FIG. 3.

As best illustrated in FIGS. 2, 3, and 5, the base enclosure 30 houses a motor drive means, such as an electric motor 32, along with suitable wiring, control circuits and the like which are of conventional design well known to those skilled in the art and which, for simplicity, are not illustrated.

Figure 4:
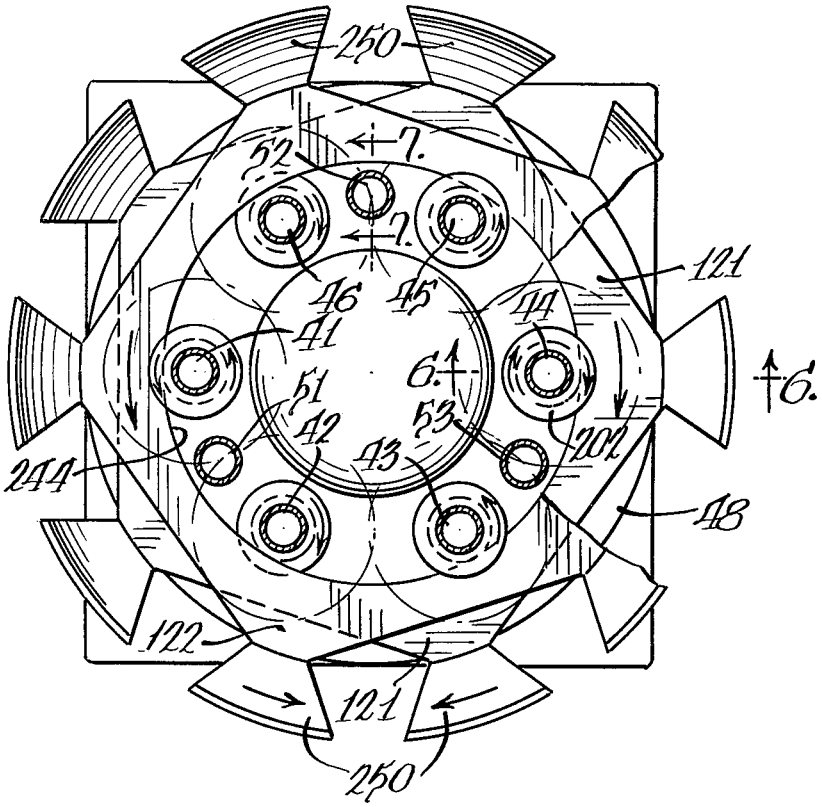
FIG. 4 is a cross-sectional view taken along the plane 4—4 in FIG. 3.

FIGS. 3, 4, and 5 show a plurality of upstanding drive rods, 41, 42, 43, 44, 45, and 46, which are mounted on the base enclosure 30 through a base plate 48 secured to the top of the base enclosure 30. Each upstanding drive rod is mounted for rotation about its individual longitudinal axis relative to the base by means of suitable bearings mounted at its lower end in the base and at its upper end in a top support plate 50 (FIG. 3) as will be explained in more detail hereinafter.

Figure 7:
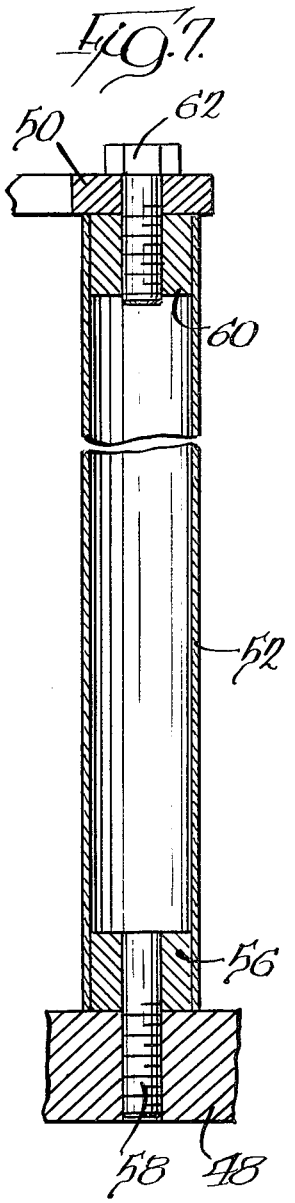
FIG. 7 is a fragmentary cross-sectional view of a support column of the stand of the present invention taken along the plane 7—7 in FIG. 4.

The top support plate 50 has a generally annular configuration and is fixed above the base enclosure 30 by three equidistantly-spaced tubular support rods 51, 52, and 53 as best illustrated in FIGS. 3 and 4. In FIG. 3, only support rod 52 is visible. All three support rods 51, 52, and 53 are visable in the cross-sectional plan view in FIG. 4. An enlarged cross-sectional view of the support rod 52 is illustrated in FIG. 7. The support rod 52 has a plug 56 force fit in its lower end, by means of which the support rod 52 is secured to the base plate 48 by screw 58. The upper end of support rod 52 has a plug 60 force fit therein, by means of which the support rod 52 is secured to the annular top support plate 50 by bolt 62. The other two support rods, 51 and 53, are identically mounted between the base plate 48 and the top support plate 50.

Figure 6:
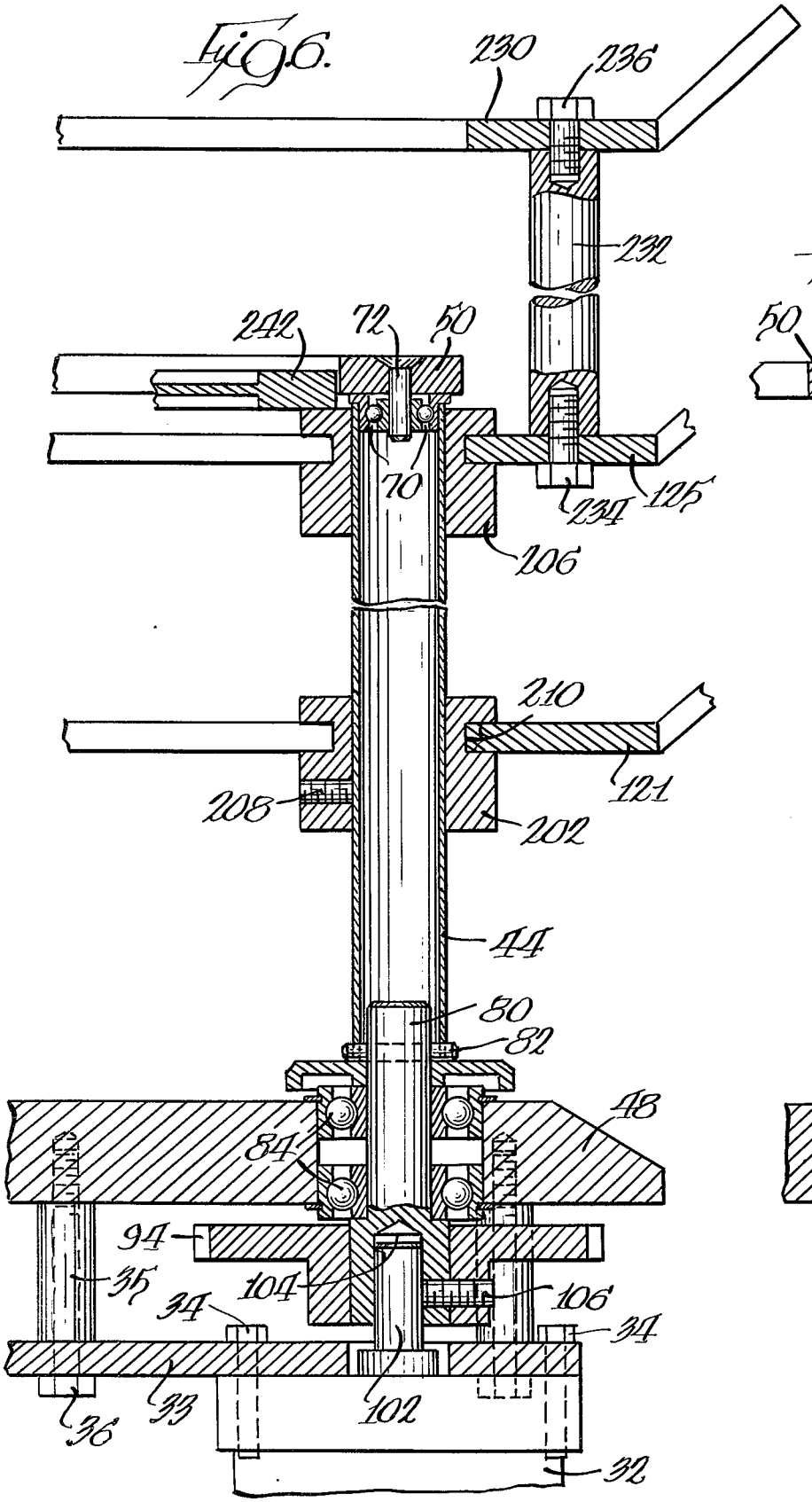
FIG. 6 is a greatly enlarged, fragmentary cross-sectional view of the right-hand portion of the stand illustrated in FIG. 3.

The support rods 51, 52, 53 and the top support plate 50 provide a lateral support structure for the upstanding drive rods 41, 42, 43, 44, 45 and 46, as best illustrated in FIG. 6 for the support rod 44. Specifically, the upper end of support rod 44 is mounted to bearing 70 which is secured via screw 72 to the top support plate 50. Thus, the upper end of drive rod 44 is restrained against lateral movement but is permitted to rotate about the longitudinal axis of the rod. The other drive rods are similarly secured to the top support plate 50.

At the bottom end of the drive rods, and as best illustrated in FIG. 6 for the drive rod 44, the drive rods are also mounted for rotation about their longitudinal axes. Specifically, with reference to drive rod 44, a shaft 80 is secured to the rod 44 by means of pin 82 and forms an extension of the rod 44 passing through the base plate 48 and into the interior of the enclosure 30. The shaft 80 is secured to the inner race of bearing 84. The outer race of bearing 84 is fixed to base plate 48. The other five drive rods are similarly mounted to the base plate 48.

A circular drive gear 94 is secured to the projecting shaft 80 of drive rod 44 within the enclosure 30 so that it rotatably drives rod 44. Each of the other five drive rods has a similar circular driven gear, as best illustrated in the bottom plan view of FIG. 5. Specifically, a gear 91 is secured to drive rod 41, a gear 92 is secured to drive rod 42, a gear 93 is secured to drive rod 43, a gear 95 is secured to drive rod 45, and a gear 96 is secured to drive rod 46. As clearly illustrated in FIG. 5, the gears are arranged in a circular array in which each gear meshes with, and is engaged by, an adjacent pair of gears so that every other gear must necessarily rotate in the same direction. Thus, the drive rods can rotate simultaneously as two groups—a first gorup of three rods in one direction and a second group of three rods in a second direction.

With reference to FIGS. 3 and 6, the motor 32 is drivably connected with drive rod 44 by means of a motor shaft 102 which is received in a bore 104 of projecting shaft 80 and secured thereto by screw 106.

The motor 32 is mounted within enclosure 30 to a horizontal support plate structure 33 as with bolts 34. Plate 33 is secured to, and spaced below, base plate 48 by spacer bars 35 and bolts 36.

As best illustrated in FIG. 3 an incandescent heat lamp 38 is mounted in enclosure 30 on a suitable bracket 39 secured to plate 33 with bolts 31 and spaced therefrom by spacer tubes 41. Lamp 38 projects upwardly through an aperture 37 in support plate 33 and an aperture 40 in the base plate 48.

The lamp 38 functions to heat the ambient atmosphere within the enclosure 24 to maintain the articles, such as packages of food 21, at a desired elevated temperature. To this end, the enclosure 24 preferably has a closed top and a sidewall which extends generally completely around the stand except for the previously described access opening 26, so that the enclosure 26 effectively traps the heated air, thus maintaining the packages of food 21 at the desired temperature. The electrical connections, wiring, and various other power and control components associated with the lamp 38 are of conventional design, are well known to those skilled in the art and, for simplicity and purposes of clarity, are not illustrated.

Operation of motor 32 causes the drive rod 44 and its attached gear 94 to rotate. With reference to the bottom plan view in FIG. 5, if the drive rod 44 is rotated in a counterclockwise direction, as viewed from underneath the stand in FIG. 5 and as indicated by the arrows, then drive rods 42 and 46 will also be rotated in the same counterclockwise direction. However, drive rods 41, 43, and 45 will necessarily be rotated in the opposite, clockwise direction.

The packages or articles 21 to be displayed are mounted at spaced locations above the base of the stand 20 on rotatable ring-like article holding members or rings, such as primary rings or members 121, 122, 123, 124, and 125 best illustrated in FIGS. 2, 3, 4, and 6. The article holding rings are preferably made from a lightweight, plastic material, such as that sold under the trade name Delrin.

The primary article holding rings are supported and driven by the drive rods in a novel manner. Specifically, with reference to drive rod 44, illustrated in FIG. 3 and in the enlarged cross-sectional view in FIG. 6, a plurality of fixed support drive guides or rollers, such as fixed rollers 202, 204 and 206, are mounted at vertically spaced intervals to the drive rod 44 and are secured thereto for rotation therewith.

Each fixed roller is secured to the rod by a screw, such as screw 208 for roller 202. Each roller further has an annular groove therein, such as groove 210 in roller 202. Preferably, each annular groove has a generally rectangular cross section and is adapted to receive therein the inner edge or inner annular region of one of the ring-like holding members. With respect to drive rod 44 illustrated in FIG. 6, the fixed roller 202 is shown engaged with ring-like holding member 121. The ring-like holding member 121 is supported, partially, by the fixed roller 202. Similarly, the other fixed rollers 204 and 206 are engaged with and partially support the primary ring-like holding members 123 and 125, respectively.

With reference to FIGS. 2, 3, and 4, it can be seen that each ring-like holding member 121, 122, 123, 124, and 125, is engaged at its inner circumference at three equally spaced locations by three of the fixed rollers on three of the six rods. The three rollers which engage and support a ring-like holding member are mounted on the three drive rods of one group that rotate in the same direction. In this manner, the rotation of the three rollers engaged with a ring-like holding member transmits a driving torque through frictional engagement between the roller and the ring-like holding member to rotate the ring-like holding member in the same direction as that group of drive rods.

Typically, each fixed roller comprises a suitable plastic material, such as that sold under the trade name Delrin, so that the surfaces of the annular groove in contact with the ring-like holding member are generally smooth and have a relatively low coefficient of sliding friction. Then, when the ring is rotating and a person wishes to remove an article from the holding member, the slight amount of resistance to the turning of the holding member that is applied during removal of the article overcomes the frictional driving torque of the rollers so that the holding member remains stationary while the rollers and drive rods continue to rotate relative to the article holding member and thus "slip" against the article holding member.

Preferably, each article holding member rotates in a direction opposite from the article holding member immediately above and below it. To this end, alternate article holding members are supported and driven by different groups of rods. Specifically, with reference to FIGS. 3, 4, and 5, article holding member 121 is supported and driven from rods 42, 44, and 46 which all rotate in a clockwise direction (as viewed from above the stand in FIG. 4) to drive the holding member 121 in a clockwise direction. In contrast, the ring-like holding member 122, immediately above holding member 121, is supported and driven from a second group of rods, rods 41, 43, and 45, which all rotate in a counterclockwise direction to thereby rotate the holding member 122 in a counterclockwise direction also.

In a similar manner, the holding member 123 immediately adjacent to, and above, holding member 122 is supported and driven by the same rods that support and drive the lowermost holding member 121 so that holding member 123 also rotates in a clockwise direction (when viewed from above the stand) along the holding member 121. Likewise, holding members 124 and 125 are driven in opposite directions. The overall visual effect is novel and interesting. It is achieved by the arrangement of a first and second group of holding members in a vertical array in which each member of the first group is spaced from at least one member of the second group to form an interleaved array and wherein each member of the first group rotates in a first direction and each member of the second group rotates in a second, opposite direction.

If desired, a secondary ring-like holding member 230 can be provided at the top of the stand for rotation with the topmost primary ring-like holding member 125 as best illustrated in FIGS. 3 and 6. Specifically, primary ring-like holding member 125 carries an upstanding support column 232 which is secured to member 125 with bolt 234. Secondary ring-like holding member 230 is secured to the top of support column 232 with bolt 236. Thus, holding member 125 and holding member 230 rotate together as one unit.

If desired, a central column or upstanding post 240 can be provided as illustrated in FIGS. 1 and 3 for holding and displaying a special advertising article 28 in a notch 239 above the stand. The post 240 has a threaded stud portion 241 received in a threaded bore 243 in a central support plate 242 which has a circular periphery and is disposed within the circle of drive rods. The support plate 242 is supported at its edges by the topmost fixed roller of each drive rod 42, 44, and 46. This is clearly illustrated in FIGS. 3 and 6 where the outer portion of central support plate 242 is shown resting on the upper exterior surface of fixed roller 206 at the top of drive rod 44. Consequently, the central support plate 242 is rotated about its central axis in a counterclockwise direction (when viewed from above the stand) as a result of the clockwise rotation of the supporting drive rods 42, 44, and 46.

Each ring-like article holding member preferably has a cylindrical inner wall, such as inner wall 244 illustrated for holding member 122 in FIGS. 3 and 4 and five-sided, generally polyginal exterior configuration. Each article holding member has, at each of its corners, an outwardly extending finger structure 250 illustrated for holding members 121 and 122 in FIG. 4. Each finger structure 250 is generally upwardly slanting and somewhat trapezoidal in shape. The finger structures 250 are arranged in a uniform spacing around the article holding member so that any two adjacent finger structures 250 circumscribe a notch for receiving one of the articles 121 and so that each finger is adapted to engage in end of the article in a mounting position as illustrated best in FIG. 1.

Figure 8:
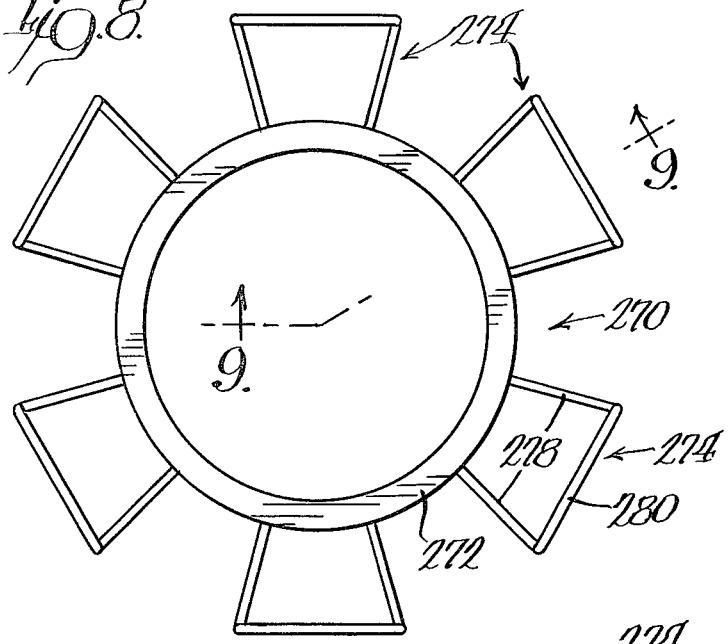
FIG. 8 is a plan view of a second embodiment of an article holding member of the stand of the present invention.
Figure 9:
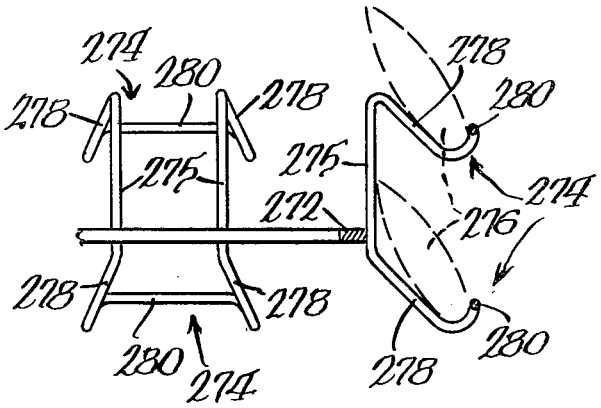
FIG. 9 is a fragmentary cross-sectional view taken along the plane 9—9 in FIG. 8.

FIGS. 8 and 9 illustrate a second embodiment of an article holding member 270. Specifically, the holding member 270 is illustrated as comprising an annular plate 272 to which is secured a plurality of pairs of vertically spaced cradles 274. Each pair of cradles 274 is formed from a wire bent into a configuration having a pair of vertical mounting posts 276 which are secured, as by welding or other suitable means, to the annular plate 272. The wire is bent to form each cradle 274 with two downwardly slanting members 278 which are curved upwardly at the lowermost point to form a generally horizontally extending crosspiece 280. The loop of wire forming the cradles 274 is thus uniquely adapted to support and hold an article 276 as illustrated in FIG. 9.

Figure 10:
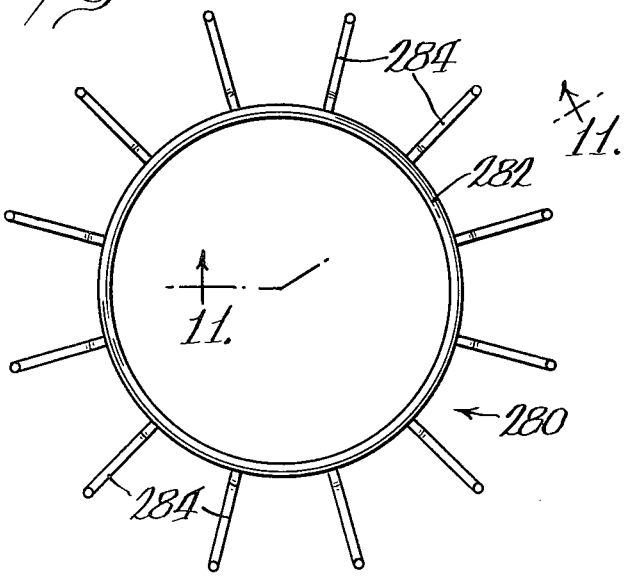
FIG. 10 is a third embodiment of an article holding member of the stand of the present invention.
Figure 11:
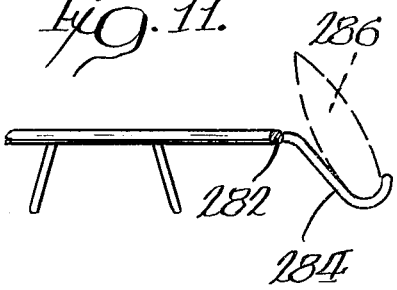
FIG. 11 is a fragmentary cross-sectional view taken along the plane 11—11 in FIG. 10.

Another embodiment of a holding member, designated generally by numeral 280, is illustrated in FIGS. 10 and 11. Holding member 280 comprises a wire ring 282 to which is secured a plurality of outwardly extending and downwardly slanting wire cradle members 284. Each cradle member 284 has an upwardly curving portion at its lowermost end to receive the bottom of an article 286 as illustrated in FIG. 11.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. An apparatus for displaying and vending articles comprising:

a base;

a plurality of article holding means disposed above said base for holding and displaying a plurality of said articles, each said article holding means having at least one cylindrical driven surface;

drive rod means mounted on said base for rotation relative thereto;

drive means on said base for rotating said drive rod means; and friction engaging means secured to said drive rod means for rotation therewith and for engaging said cylindrical driven surface of each said article holding means whereby rotation of said drive rod means simultaneously rotates said friction engaging means against said cylindrical driven surface of each said article holding means to rotate each said article holding means relative to said base and whereby, when a torque is applied to any one of said article holding means to arrest the rotation thereof during removal of an article, said friction engaging means slips relative to said one article holding means and continues to rotate the remainder of said article holding means.

2. The apparatus in accordance with claim 1 in which said article holding means is supported at spaced-apart locations by said rod means.

3. The apparatus in accordance with claim 2 in which said article holding means is directly supported by said friction engaging means on said drive rod means.

4. The apparatus in accordance with claim 1 further including means for heating the ambient atmosphere adjacent said article holding means.

5. The apparatus in accordance with claim 4 further including enclosure means mounted to said base and surrounding portions of said article holding means.

6. The apparatus in accordance with claim 1 further including enclosure means for surrounding portions of said article holding means and further including incandescent lamp means for heating the atmosphere within said enclosure means.

7. The apparatus in accordance with claim 6 in which said incandescent lamp means is mounted in said base.

8. The apparatus in accordance with claim 1 in which said drive rod means comprises a plurality of upstanding drive rods spaced equidistantly around a circle on said base.

9. An apparatus for displaying and vending articles comprising:

a base;

article holding means disposed above said base for holding and displaying a plurality of said articles, said article holding means having at least one cylindrical driven surface;

drive rod means mounted on said base for rotation relative thereto;

drive means on said base for rotating said drive rod means; and friction engaging means secured to said drive rod means for rotation therewith and for engaging said cylindrical driven surface of said article holding means whereby rotation of said drive rod means rotates said friction engaging means against said cylindrical driven surface of said article holding means to rotate said article holding means relative to said base and whereby, when a torque is applied to said article holding means to arrest the rotation thereof during removal of an article, said friction engaging means slips relative to said article holding means and continues to rotate, said drive rod means comprising six upstanding drive rods space equidistantly around a circle on said base, said article holding means including a plurality of ring members, each said ring member being disposed around said six drive rods and each said ring member having an inner cylindrical surface on its inner diameter, said friction engaging means including a plurality of generally cylindrical rollers, each roller mounted to one of said drive rods with its longitudinal axis coincident with the drive rod axis, each roller defining an annular groove therein, said annular groove having a generally rectangular cross-section and receiving therein a portion of one of said ring members in frictional engagement whereby each said ring member is rotated by frictional engagement with at least one roller transmitting a driving torque and whereby, when a predetermined amount of resistance torque is externally applied to said ring member upon removal of an article from said ring member, the frictional driving torque is overcome and said ring member remains stationary while said roller continues to rotate relative to said ring member.

10. An apparatus for displaying and vending articles comprising:

a base;

article holding means disposed above said base for holding and displaying a plurality of said articles, said article holding means having at least one cylindrical driven surface;

drive rod means mounted on said base for rotation relative thereto, said drive rod means comprising a plurality of upstanding drive rods sapced equidistantly around a circle on said base;

support means for restraining the distal ends of said drive rods against lateral movement;

drive means on said base for rotating said drive rod means; and friction engaging means secured to said drive rod means for rotation therewith and for engaging said cylindrical driven surface of said article holding means whereby rotation of said drive rod means rotates said friction engaging means against said cylindrical driven surface of said article holding means to rotate said article holding means relative to said base and whereby, when a torque is applied to said article holding means to arrest the rotation thereof during removal of an article, said friction engaging means slips relative to said article holding means and continues to rotate.

11. An apparatus for displaying and vending articles comprising:

a frame;

friction engaging drive means mounted to said frame and adapted to rotate relative thereto; and a plurality of article holding means for holding and displaying a plurality of said articles, each said article holding means being frictionally engaged with and supported by said friction engaging drive means whereby rotation of said friction engaging drive means simultaneously rotates said article holding means relative to said frame and whereby, when a torque is appled to any one of said article holding means to arrest the rotation thereof during removal of an article, said rotating friction engaging means slips relative to said one article holding means and continues to rotate the remainder of said article holding means.

12. An apparatus for displaying and vending articles comprising:

a base;

a plurality of upstanding drive rods spaced equidistantly around a circle on said base and mounted to said base for rotation about their longitudinal axes;

motor means secured to said base;

gear drive means drivably connecting said motor means with each of said drive rod means for rotating said drive rods about their longitudinal axes;

a plurality of upstanding support rods mounted to said base;

a top support plate mounted to the distal ends of said upstanding support rods, said top support plate engaging the distal ends of said drive rods to prevent lateral movement of the drive rods while permitting rotation of the drive rods;

a plurality of rollers mounted to said drive rods with at least one roller mounted on each drive rod and secured thereto for rotation therewith, each said roller defining an annular groove therein, each said annular groove having a generally rectangular cross section;

a plurality of primary ring-like article holding members upon which said articles are placed for display, each primary ring-like article holding member disposed generally horizontally around said plurality of drive rods and supported at a location spaced from said base by said rollers, an annular inner portion of each said primary ring-like article holding member being received within said annular grooves in a number of said rollers at spaced locations around the inner circumference of said ring-like member whereby rotation of said drive rods rotates said rollers against said primary ring-like article holding members to thereby rotate said primary article holding members and whereby, when a predetermined amount of resistance torque is applied to one of said primary ring-like article holding members upon removal of an article from that primary article holding member, the frictional driving torque is overcome and that primary article holding member remains stationary while said rollers and drive rods continue to rotate relative to the primary article holding member.

13. The apparatus in accordance with claim 12 in which said roller comprises a plastic material and in which the exterior surfaces of said annular groove in each said roller are generally smooth and have a relatively low coefficient of sliding friction.

14. The apparatus in accordance with claim 12 in which the topmost primary ring-like article holding member has upwardly projecting support columns and in which a secondary ring-like article holding member is secured to said support columns above said topmost primary ring-like article holding member for rotation therewith.

15. The apparatus in accordance with claim 12 in which three of said drive rods are spaced around the circle on said base at 120 degree increments, in which at least one of said rollers is mounted on each of said three drive rods at the same elevation above the base, and in which a central support plate having a circular periphery is disposed within said drive rods and is supported at its edges by the rollers on said three drive rods, said central support plate having an upstanding post for receiving an article thereon for display above said ring-like article holding members.

16. The apparatus in accordance with claim 12 further including a transparent enclosure means for surrounding said ring-like article holding members, said enclosure means defining an aperture extending upwardly from said base to permit access to said articles as they are rotated past said aperture on said article holding members.

17. The apparatus in accordance with claim 16 further including an incandescent lamp mounted in said base for heating the ambient atmosphere within said enclosure means.

18. The apparatus in accordance with claim 12 in which each of said primary ring-like article holding members includes a plurality of outwardly extending fingers arranged in pairs wherein each pair of fingers circumscribes a notch for receiving one of said articles and wherein each finger is adapted to engage an end of one of said articles.

19. The apparatus in accordance with claim 12 in which each of said primary ring-like article holding member includes a plurality of outwardly extending and downwardly slanted wire cradle members for holding said articles.

20. The apparatus in accordance with claim 12 in which each of said primary ring-like article holding member includes a plurality of wire cradles comprising a loop of wire extending outwardly and slanting downwardly and adapted to receive an article therein.

21. The apparatus in accordance with claim 12 in which an even number of said drive rods are provided, in which each said drive rod has a mounting end projecting into said base, in which said gear drive means includes a plurality of circular gears, one gear secured to each said drive rod mounting end in said base forming a circular array of gears in said base, each said gear meshing and engaged with an adjacent pair of said gears, and in which one of said drive rods is mechanically connected to the shaft of said motor means for rotating said rod and the circular drive gear thereon whereby one-half of the even number of drive rods are rotated in a first direction and one-half are rotated in a second, opposite direction.

22. The apparatus in accordance with claim 21 in which said primary ring-like holding members are disposed in a vertical array above said base, one of two adjacent primary ring-like article holding members engaged by those of said drive rods rotating in the first direction and the other of the two adjacent primary ring-like article holding members engaged by those of said drive rods rotating in the second opposite direction whereby said two adjacent primary ring-like article holding members rotate in opposite directions.

23. The apparatus in accordance with claim 21 in which six drive rods are provided on said base, a first group of said drive rods comprising three drive rods rotating in said first direction and a second group of said drive rods comprising three drive rods rotating in said second, opposite direction; in which said primary ring-like article holding members are arranged in a spaced-apart vertical array above said base, one of said ring-like article holding members engaged by three rollers on said first group of drive rods and driven in said first direction, each of the two adjacent primary ring-like article holding members above and below said one primary ring-like article holding member engaged by three rollers on the second group of drive rods and driven in the second, opposite direction by said second group of drive rods.

24. The apparatus in accordance with claim 12 in which said primary ring-like article holding members are disposed in a first and second group, each member rotatable about a common axis substantially normal to the plane of the member; said first and second groups of holding members together constituting an array of members in which each member of said first group is independently rotatable in a first direction and in which each member of said second group is independently rotatable in a second, opposite direction, each member of said first group being adjacent and spaced from at least one member of said second group to form an interleaved array, said drive rods being arranged in a first group adapted to rotate in said first direction and a second group adapted to rotate in said second, opposite direction, said first group of drive rods driving said first group of article holding members and said second group of drive rods driving said second group of article holding members.

25. An apparatus for displaying and vending articles comprising:

a frame;

combination drive means including a first drive means mounted to said frame and adapted to rotate relative thereto in a first direction and a second drive means mounted to said frame and adapted to rotate relative thereto in a second, opposite direction; and a plurality of article holding members for holding and displaying a plurality of said article, said members being independently rotatable about a common axis substantially normal to the plane of each member and arranged in a first and second group together constituting a spaced array in which each member of said first group is spaced from and adjacent to at least one member of said second group, each member of said first group of article holding members being frictionally engaged with and supported by said first dirve means to rotate in said first direction and each said member of said second group of article holding members frictionally engaged with and supported by said second drive means for being rotated in said second, opposite direction whereby, when a torque is applied to one of said article holding members to arrest the rotation thereof during removal of an article, the drive means engaged therewith slips relative to said article holding member and continues to rotate.

26. The apparatus in accordance with claim 9 in which each ring-like article holding member is engaged by three rollers, each one of the three rollers which engage a single article holding member being mounted on separate drive rods at 120 degree spaced-apart circumferential locations relative to that article holding member.

27. The apparatus in accordance with claim 10 in which said support means include a plurality of upstanding support rods mounted to said base and a top support plate mounted to the distal ends of said support rods, said top support plate engaging the distal ends of said drive rods to prevent lateral movement of the drive rods while permitting rotation of the drive rods.

* * * * *

UNITED STATES PATENT AND TRADEMARK OFFICE

CERTIFICATE OF CORRECTION

PATENT NO. : 4,236,769

DATED : December 2, 1980

INVENTOR(S) : Martin L. Mueller

It is certified that error appears in the above-identified patent and that said Letters Patent are hereby corrected as shown below:

Column 1, line 23, "of" should be --at--.
Column 1, line 25, "longidutinal" should be --longitudinal--.
Column 1, line 30, insert "the" before "other half."
Column 4, line 63, "enclosure 26" should be --enclosure 24--.
Column 6, line 50, "of" should be --on--.

Column 9, line 35, "appled" should be --applied--.

Signed and Sealed this

*Thirty-first* Day of *March 1981*

[SEAL]

*Attest:*

RENE D. TEGTMEYER

*Attesting Officer* *Acting Commissioner of Patents and Trademarks*